United States Patent [19]

Wachter

[11] Patent Number: 4,891,858

[45] Date of Patent: Jan. 9, 1990

[54] ROADWORKING APPARATUS

[75] Inventor: Johann Wachter, Mannsworth, Austria

[73] Assignee: Famag Fahrzeug- und Maschinenhandelsgesellschaft m.b.H. Nfg.KG., Vienna, Austria

[21] Appl. No.: 166,411

[22] Filed: Mar. 22, 1988

[30] Foreign Application Priority Data

Mar. 23, 1987 [AT] Austria ..... 686/87
Mar. 26, 1987 [AT] Austria ..... 744/87-1

[51] Int. Cl.[4] ..... F01H 5/09; F01H 1/02

[52] U.S. Cl. ..... 15/82; 15/93 R; 15/179; 15/183; 51/74 R; 51/176; 37/233

[58] Field of Search ..... 15/82, 83, 84, 93 R, 15/340, 179, 183; 51/74 R, 176; 37/232, 233

[56] References Cited

U.S. PATENT DOCUMENTS 2,278,306 3/1942 Cushman ..... 15/82

FOREIGN PATENT DOCUMENTS 434407 9/1926 Fed. Rep. of Germany .
855123 7/1949 Fed. Rep. of Germany .
1026771 3/1958 Fed. Rep. of Germany ..... 15/82
1759622 7/1972 Fed. Rep. of Germany .
2455200 5/1976 Fed. Rep. of Germany ..... 15/82
2821627 11/1979 Fed. Rep. of Germany ..... 15/82
695207 8/1953 United Kingdom ..... 15/82
1183575 3/1970 United Kingdom .
2126633 3/1984 United Kingdom .

*Primary Examiner*—Edward L. Roberts
*Attorney, Agent, or Firm*—Young & Thompson

[57] ABSTRACT

An apparatus for working the surfaces (4) of traffic areas (5) comprises a roll (16) rotatably drivable about a substantially horizontally extending axis (17), this roll carrying along its periphery working elements acting on the surface (4) to be treated. The roll (16) is supported with respect to the frame (1) of the apparatus by adjustable servo members (21) and is additionally tiltable about an axis that is perpendicular to the axis of rotation (17) of the roll (16) and is oriented essentially horizontally. Furthermore, a rotary brush (101) is disclosed for the working of traffic areas and for removing layers from the surface, exhibiting a brush core (102) with working elements attached to the latter. The working elements (120), received in holding members (114), are attached to the brush core (102) by way of mounting strips (106) extending in the longitudinal direction of the brush axis (103), these mounting strips resting on the radially outwardly disposed peripheral surface of the brush core (102) and being connected to the latter. Each mounting strip (106) exhibits outwardly pointing extensions (107) which latter have holes (108) through which is passed a mounting shaft (109) for the working elements (120) or for the holding members (114) thereof.

50 Claims, 7 Drawing Sheets

FIG. 1
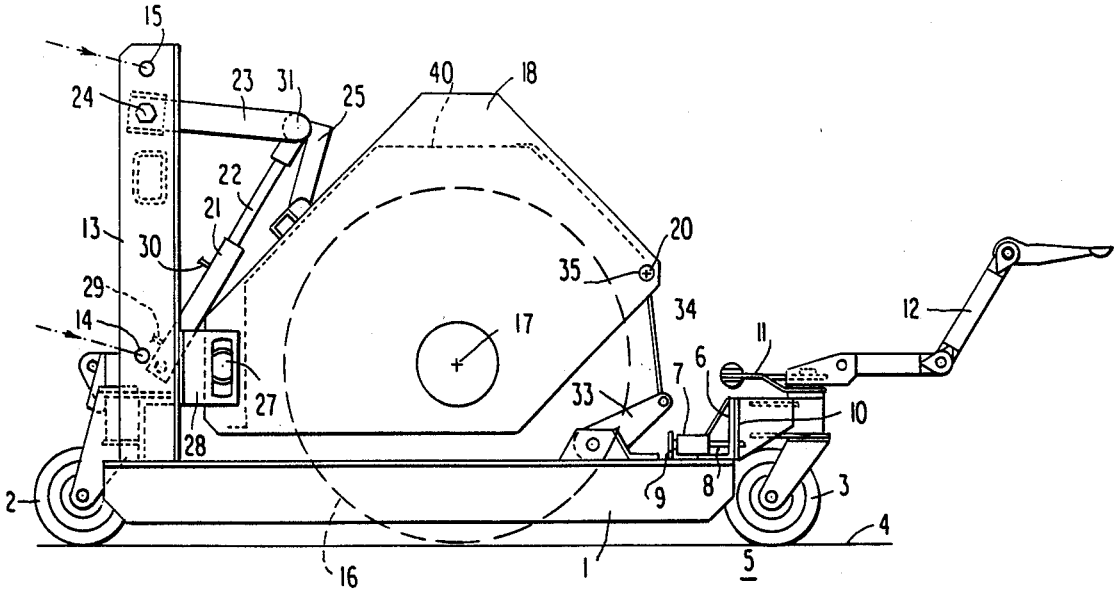
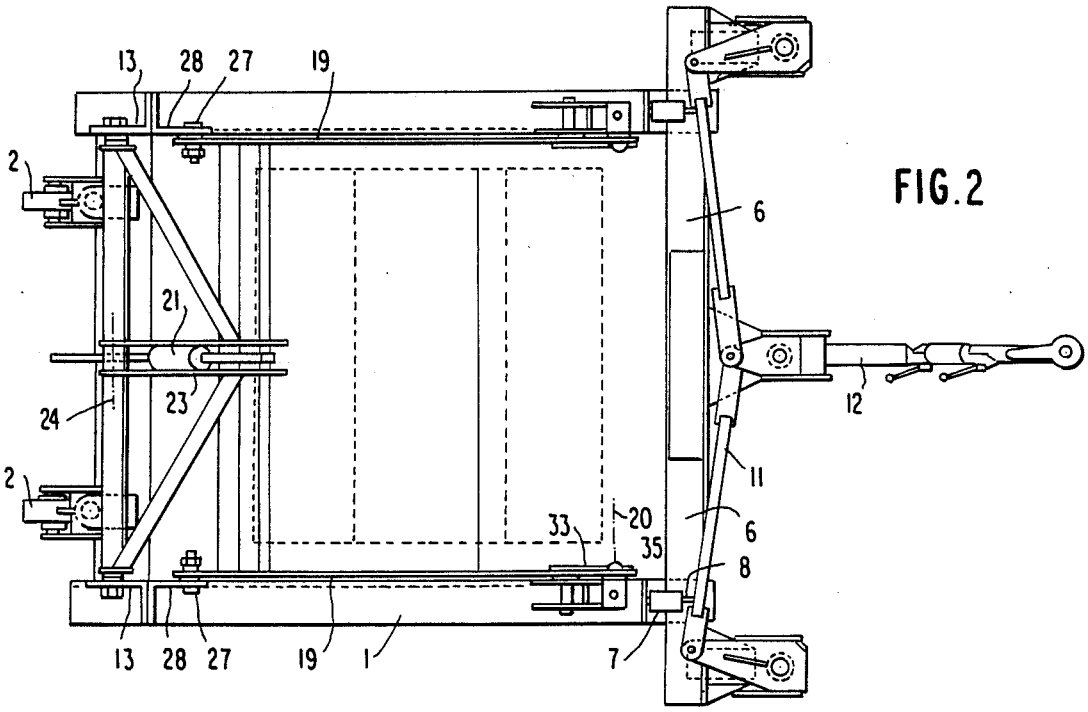
FIG. 2

FIG. 3
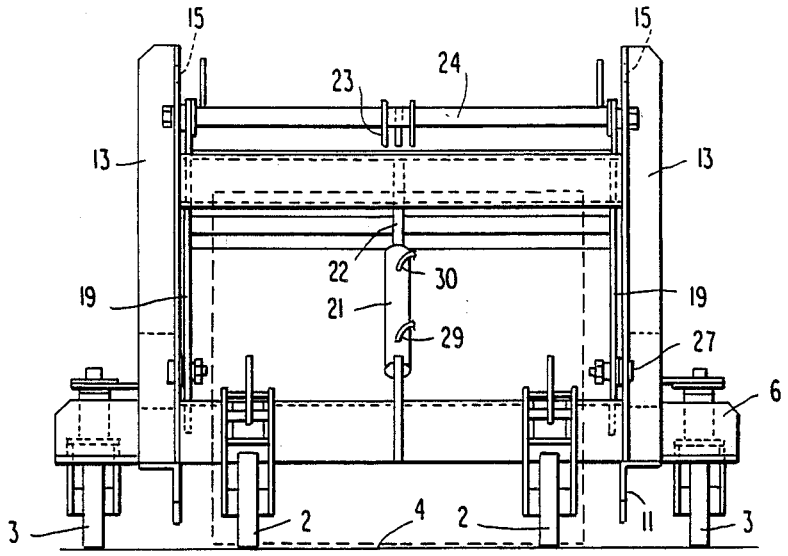
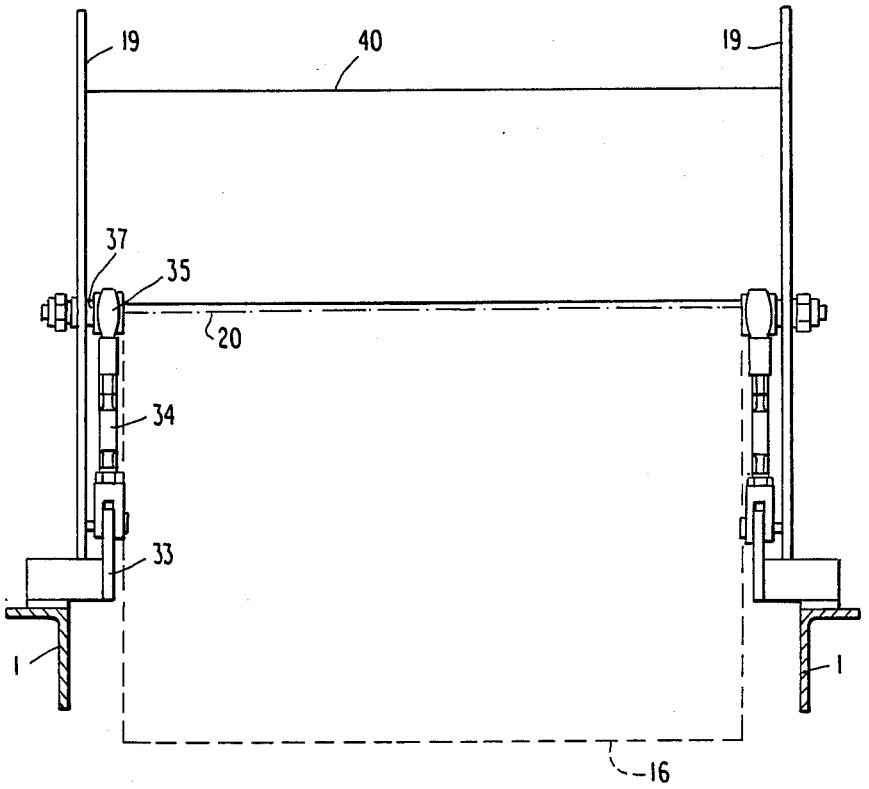
FIG. 4

FIG. 9
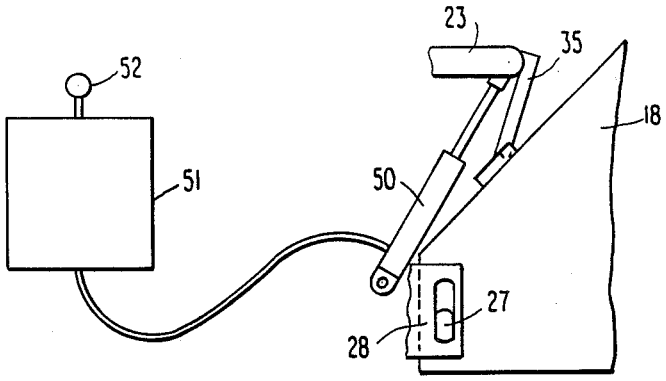
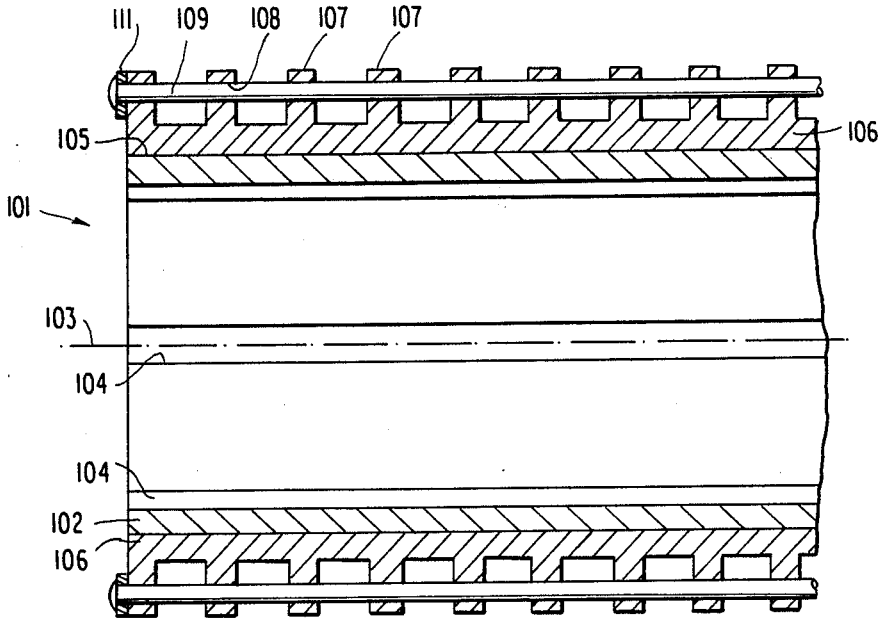
FIG. 10

FIG. 11
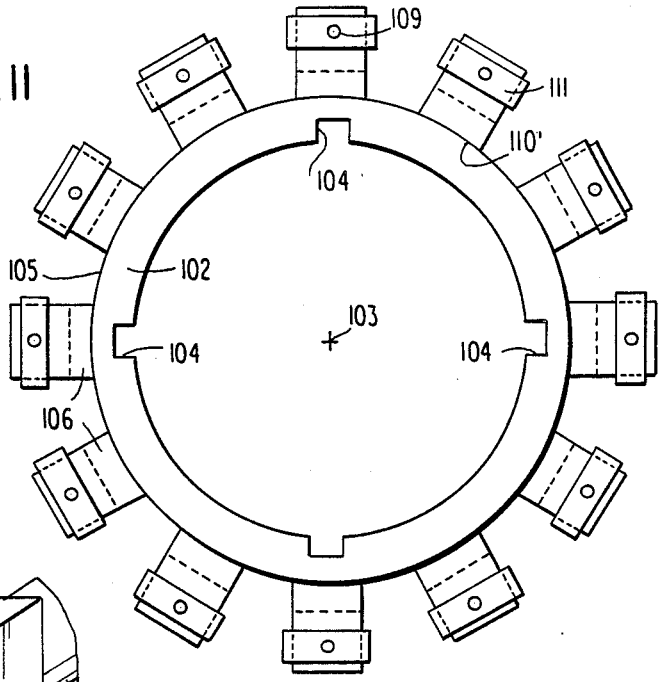
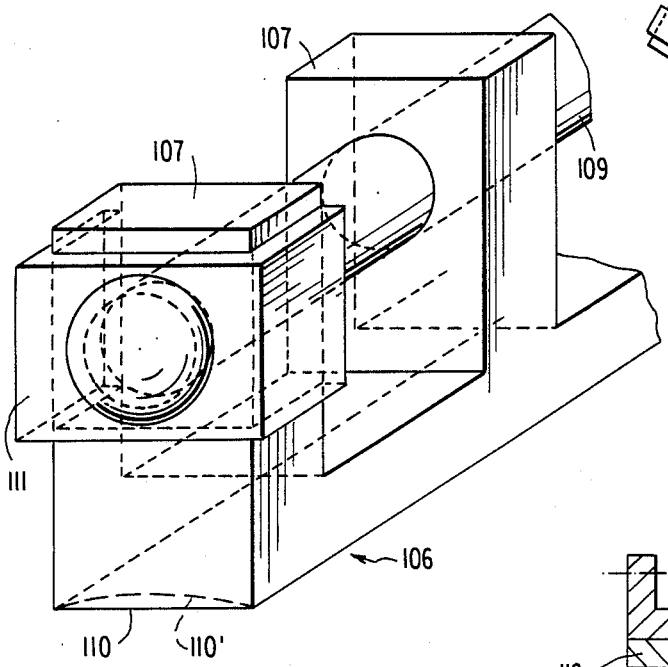
FIG. 12
FIG. 13
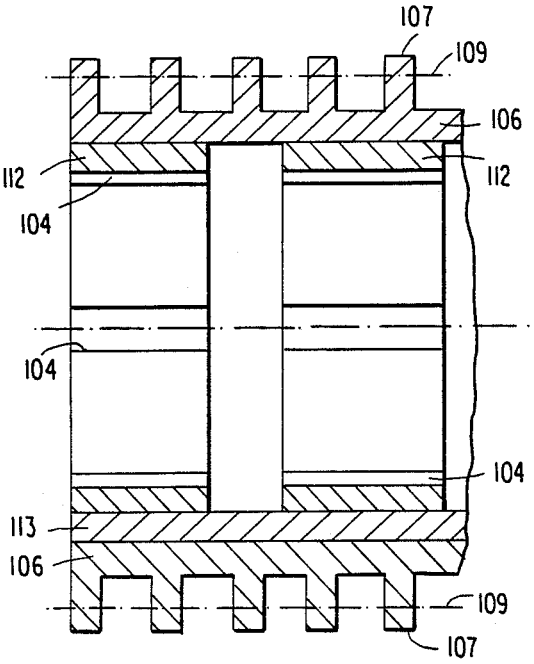

FIG.14
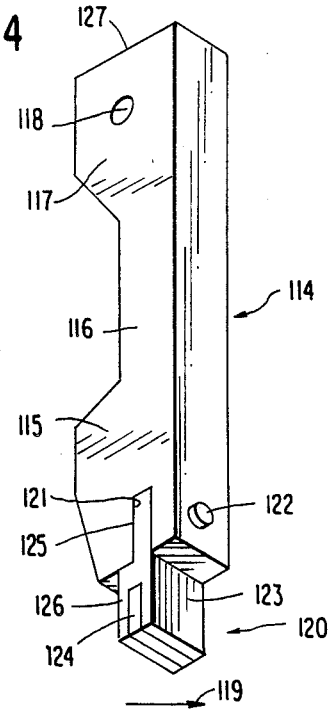
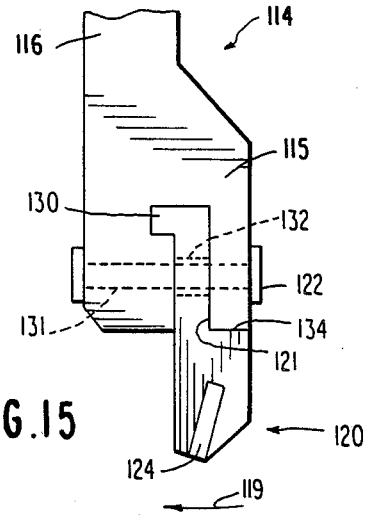
FIG.15
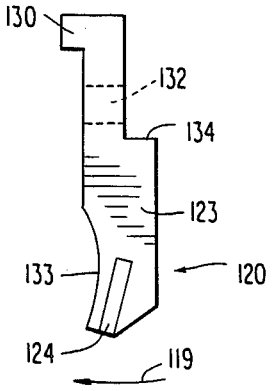
FIG.16

ROADWORKING APPARATUS

The invention relates to an apparatus for treating the surface of traffic areas with the aid of a motor-driven roll rotatable about a substantially horizontally extending axis, this roll carrying working elements on its circumference which elements act on the surface to be treated, the roll being mounted in a support. One end of this support, preferably the forward end as seen in the travel direction, is arranged at the frame of the apparatus, which frame is preferably resting on the traffic area by way of wheels, to be pivotable about an axis in parallel to the axis of rotation of the roll; and the other end of this support, preferably the rearward end, is coupled with at least one servo member resting on the frame of the apparatus.

In such devices, used, for example, for removing dirt, snow, ice, abraded rubber, or markings from traffic areas, or serving for treating the surface of traffic areas in an abrasive fashion, the correct alignment of the roll and, respectively, of its working elements with respect to the surface to be worked on represents a problem.

DE-B-1,759,622 discloses a rotary brush supported by means of a hydraulic power cylinder on a trestle connected to a power cylinder. Valves provided in the hydraulic lines leading to the power cylinder supply this power cylinder with pressure medium in such a way that the power cylinder relieves the rotary brush from the weight, acting thereon, of the supporting unit and of the rotary brush proper. In this arrangement, using an overflow valve, the pressure in the power cylinder can also be dimensioned so that only part of the weight is compensated for, and contact pressure is exerted by the rotary brush against the traffic area. In DE-B-1,759,622, the aforementioned balancing of the weight is not achieved by a bilaterally actuatable piston of a pressure medium motor.

Also in DE-C-855,123, the rotary brush is supported by way of the lever arm carrying the brush by means of a pressure medium motor acted upon by pressure medium from only one side. This pressure medium motor is associated with an air bladder so that the motor acts as a servo member.

In DE-C-434,407, a suspension unit for a sweeping roll is described associated with a dual leaf spring which has the task of compensating for the weight of the roll; for this purpose, setscrews are provided.

In British-C-1,183,575, a sweeping unit is shown wherein the rotary brush is supported by means of pneumatic cylinders and can be lifted off the traffic area. By adjusting the pressure acting on the pneumatic cylinders, the contact pressure of the rotary brush against the road surface can be adjusted.

All conventional devices contain the disclosure that attempts are made to support the roll by suitable measures and thus adjust its pressure against the traffic area, for which purpose the weight of the roll is more or less strongly "balanced". None of the references teaches the idea of maintaining a rotary brush in a predetermined level alignment with respect to the traffic area.

The invention is based on the object of improving the conventional devices of the type discussed above in such a way that adjustment of the vertical alignment of the roll with respect to the road surface to be treated is possible in a simple way, and that the roll at the same time acts on the surface with the required contact pressure.

According to the invention, this object has been attained by providing that the roll is held at the desired level position with respect to the traffic area to be treated as related to the frame of the apparatus, by means of at least one servo member fashioned as a pressure medium motor which latter can be supplied with a pressure medium, especially compressed air, with a preselectable, constant pressure; that the pressure medium motor serving as the servo member can be supplied with the pressure medium by way of an accumulator for the pressure medium with a preselectable, constant pressure; that the end of the support where the servo member engages is guided to be displaceable upwards and downwards at the frame of the apparatus; and that the roll can be tilted about an axis that is perpendicular to the roll axis and is oriented substantially horizontally.

It is possible in the apparatus of this invention to exactly adapt the roll to the respective requirements of its usage and simultaneously also to adjust the contact pressure of the roll to the desired value.

This is accomplished with the use of a single-acting pneumatic cylinder as the servo member in such a way that this cylinder is supplied with compressed air via the accumulator (compressed-air tank) to such an extent that the stationary roll is at a point where it is not as yet lifted up. Only upon rotation of the roll, the latter is raised under the action of the working elements engaging the surface to the treated and enters into a floating position which is especially well adapted to any surface roughness of the terrain.

Since it is possible in the apparatus of this invention to maintain the roll to be fully mobile in any desired immersion depth, independently of its chassis, a uniform stripping depth is likewise ensured during the stripping treatment of traffic areas Due to the fact that, according to one embodiment of the invention, two oppositely acting servo members are provided, fashioned as pressure medium motors (or as a dual-acting pressure medium motor), an especially simple adjustment of the roll is made possible. The pressure medium motor acting from the bottom toward the top urges the roll from the bottom toward the top and thus determines initially the vertical position of the roll with respect to the frame of the apparatus and therefore with respect to the road surface. The simultaneously activated pressure medium motor acting on the roll from the top toward the bottom performs the final level adjustment of the roll, and the combination of both pressure medium motors finally retains the roll in a floating position during the treatment of the traffic area.

It is thus possible by means of the apparatus of this invention to keep the roll fully movable in any desired immersion depth independently of its chassis so that the roll can very well adapt itself to unevennesses of the surface and the danger of unintended destruction of the surface, for example in case only layers are supposed to be stripped off therefrom, is avoided. Also in the abrading treatment of traffic areas, a uniform stripping depth is ensured on account of the structure of the apparatus in accordance with this invention.

The accumulator provided according to this invention serves for keeping the contact pressure constant even in case of uneven terrain so that even when traveling over surface roughnesses, the adjusted floating position of the roll is maintained. This effect will be explained hereinbelow:

When the roll is moving over rough terrain, the roll body executes differing movements. In case of a rise in the surface of the traffic area, the pressure medium motor acting on the roll from the top toward the bottom is compressed and the increased operating power built up thereby in the motor would urge the roll downwardly to an increased extent, and a corresponding counterforce would act on the roll. However, on account of the fact that the pressure in the respective pressure medium motor serving as the servo member is kept constant, the increased operating power is not produced, and the roll is pressed with an always constant force against the road surface and retains its preset floating position When the roll is traveling over a depression in the surface of the traffic area to be worked, analogous processes take place.

A further improvement of the adaptation of the roll of the device of this invention to road roughness, as compared with the sweeping rolls existing in the prior art, results from the feature that the roll can be tilted about an axis that extends perpendicularly to its axis. On account of this additional tilting capability of the roll transversely to its axis of rotation, i.e. transversely to its travel direction over the traffic area to be treated, the roll according to this invention is movably supported toward all directions, and yet retains the desired vertical alignment with respect to the traffic area to be worked upon.

Since in the apparatus of this invention the servo member(s) carrying the roll is or are designed as a pressure medium motor supplied with pressure medium (compressed air) with the interposition of a reservoir for the pressure medium, the advantage is obtained that adjustment can take place faster and more simply than with the use of coil springs, for example.

The invention furthermore relates to a rotary brush for treating traffic areas, especially for removing from the surface thereof layers such as dirt, snow, ice, paint, abraded rubber, or the like, with a brush core to which are mounted working elements optionally arranged at mounting members by way of holders provided on the outer circumference of the brush bore, to be pivotably movable optionally about axes extending in parallel to the brush axis.

Circular brushes (roller brushes) are known in a great variety of different designs.

Thus, rotary brush structures are known from DE-C-815,967; DAS 1,290,919; DE-C-1,057,562; British A-726,940; British A-1,251,259, Swiss A-353,026; and US A-3,134,123, 3,200,430, 3,228,053, 3,715,773, and 4,498,210, wherein strip-shaped mountings for bristle clusters can be inserted in ordinarily axially parallel grooves of the brush body. In all these conventional circular brushes, the bristle clusters are retained so that they are not pivotable with respect to the brush body, and they can deviate from their position wherein they project radially from the brush body only with elastic deformation of the individual bristles proper. This rigid mounting of the bristle clusters places a very great stress on the bristles so that they wear down and/or break off rapidly.

In another group of circular brushes, the bristle clusters are articulated to an essentially cylindrical carrier member (brush bore), there being no resultant preferred pivoting axis of the bristle clusters Thus, DE-C-286,512 discloses a circular brush wherein the bristle groups are attached via coil springs to the brush body to be pivotable in all directions. DE-C-352,183 describes a circular brush serving as a matte-polishing beater brush wherein bristle clusters are attached to a supporting member so that they are pivotable via several rings into any desired directions. Another possibility of a connection pivotable in all directions for bristle clusters of a revolving circular brush with the supporting member of the latter is shown in DE-C-289,181 wherein pins having flattened heads, to which the bristle clusters are attached, engage through holes in the tubular supporting member and are held at that location by the heads. Finally, DE-C-286,513 discloses the arrangement of rubber strips instead of the bristles for a scrubbing roller for street cleaning machines, these rubber strips being attached to the core of the roller brush via coil springs and nuts.

Austrian patent application No. 100/84, published on Feb. 15, 1985, describes a roller brush for track-laying machines wherein hose-like clearing arms are attached to the brush core by means of a clamping screw connection. The hose-like clearing arms are to consist of a flexurally elastic material and do not exhibit any design features at their radially outer ends to prevent increased wear. In these conventional rotary brushes, the bristle clusters are not mounted to be movable about defined pivoting axes.

It has also been suggested (cf. Austrian Pat. No. B-305,350 and US A-3,545,026) to design, in circular brushes, bristles which are pivotable about axes in parallel to the axis of rotation of the brush, but the pivotability of the bristles merely serves for adjusting the bristles in a specific angular position with respect to the radial plane. Similar suggestions are contained in US A-3,545,026 wherein the pivoting of the bristles is to take place automatically under the contact pressure of the roller brush against the object to be cleaned.

It is, finally, also conventional from British A-962,604 to attach bristle clusters to the core of a roller brush by way of clamping means and elastic intermediate members provided at that location, so that the bristle clumps can move resiliently to and fro with elastic deformation of the connecting elements about axes in parallel to the axis of rotation of the roller brush. The brush structure disclosed in British A-962,604 is, however, very expensive with respect to the mounting of the bristle clusters with clamping means and multiple rivet and/or screw connections; moreover, exchanging of worn bristle clumps is troublesome.

All of these conventional roller brushes exhibit the disadvantage that comparatively long bristles (working elements) are utilized which are fashioned to be correspondingly elastic and consequently have little wear resistance.

The known circular brushes have the drawback that a compromise must be sought when selecting the material for the bristles, between abrasion resistance and the elastic properties of the bristles required for the purpose of usage of the circular brush.

EP-A 0,172,157 discloses holding members for working elements of rotary brushes

The invention is based on the object of providing a rotary brush to which the working elements of their mounting members, especially holding members of the type known from EP-A 0,172,157, can be fastened in a simple way, wherein the brush elements and, respectively, the working elements provided at the mounting members of such rotary brushes are to be readily exchangeable. Exchanging of the working elements becomes necessary after they have worn down, or in case the equipment of rotary brushes is to be adapted to the respective usage of the rotary brush. This rotary brush is to be utilized with advantage in an apparatus according to one or several of claims 1 through 24.

This object has been attained according to this invention by providing that the holders are designed as mounting strips extending in the longitudinal direction of the axis of the rotary brush, these mounting strips, in contact with the radially outwardly disposed peripheral surface of the brush core, being joined to the latter by screws, glue, welding, or the like.

As contrasted to the rotary brush structures known heretofore, the holders in the rotary brush according to this invention are not inserted in axially parallel-extending grooves of the rotary brush, but rather are simply arranged at the outer peripheral surface of the brush. Thereby, exchanging of the working elements is considerably simplified since the mounting locations of the mounting strips or the connection between the mounting strips and the working elements become more readily accessible. Moreover, a substantially simpler structure of the brush core results in the rotary brush according to this invention inasmuch as longitudinally extending grooves in the outer peripheral surface thereof are no longer required.

Preferably, within the scope of this invention, the mounting strips are joined to the brush core by means of screws to be detachable, the screws being preferably socket head screws with locknuts.

An especially firm seating of the mounting strips at the roller core is attained by providing the mounting strips with surfaces resting on the brush core and having a concave configuration in correspondence with the curvature of the brush core. In this connection, the provision is preferably made that the radius of curvature of the surface of the mounting strips resting on the brush core is smaller than the radius of the outer circumferential surface of the brush core. Owing to this configuration, an especially secure and play-free connection is ensured between the mounting strips and the brush core without the necessity of making the radii of curvature of the mounting strip surface resting on the roller core and of the curvature of the outer surface of the brush core to be exactly corresponding to each other.

In a preferred embodiment of the invention, the provision is made that the mounting strips exhibit extensions projecting toward the outside and arranged at mutual spacings; these extensions have holes oriented in parallel to the rotary brush axis in order to receive a mounting shaft for the working elements or their holding elements. Beside other possible ways of mounting holders or brush elements to the mounting strips, this embodiment achieves an especially simple connection between working elements and, respectively, their holding members, and the brush core; in this arrangement, the working elements can be fastened to be pivotably movable about axes in parallel to the axis of rotation of the brush It is preferred to provide, at one end of the mounting shaft, an essentially U-shaped bracket extending from the outside around an axially outermost extension of the mounting strip, and to arrange at the other end of the mounting shaft a threaded section and a nut threaded thereon. By means of this structure, it is ensured that the mounting shaft is connected to the mounting strip in an especially secure fashion and, moreover, that a simple connection is established between the mounting strip and the mounting shaft.

In accordance with another embodiment of the invention, the provision is made that mutually adjacent mounting strips are joined to the brush core to be offset in the longitudinal direction of the latter. This structure achieves the objective, in a particularly simple way, that the working elements fastened to mutually neighboring mounting strips are disposed offset in the direction of the axis of the rotary brush; this is of special advantage for the efficiency of the rotary brush (cf., in this connection, Austrian B-366,126).

The concrete design of the roll core of the rotary brush according to this invention is not of primary significance for the invention. However, it is preferred to design the brush core as a continuous tube. This embodiment, permitting special stability of the roll core and thus a correspondingly weaker dimensioning of the mounting strips, is preferably characterized in that longitudinally extending grooves are provided on the inner surface of the brush core, these grooves being engaged by longitudinally extending ribs provided at a drive shaft for the rotary brush.

In accordance with another preferred embodiment of the invention, the provision is made that the brush core is constituted by spaced-apart rings In this embodiment, distinguished by lower weight, the provision can be made that the mounting strips are directly threaded to the rings. Alternatively, the provision can be made that the rings are joined to one another by means of longitudinally extending connecting strips, the mounting strips being joined to the latter while resting on the radially outwardly disposed surfaces of the connecting strips.

In order to connect the rotary brush and/or its brush core with the associated drive mechanisms and bearings, couplings can be arranged at the end faces of the brush core in order to connect the latter to a drive motor and/or to the bearings of the rotary brush. As an alternative, the rotary brush can be placed onto a correspondingly dimensioned drive shaft equipped with entraining elements ensuring a shape-mating connection to the core of the rotary brush.

The invention relates furthermore to a brush element with a working element, connected by way of a mounting member to the brush core of a rotary brush, wherein the working element is attached at the mounting member in a slot of a radially outwardly located head of the mounting member. This brush element is distinguished in that the working element exhibits a platelet of a hard material, such as a hard metal, attached, for example by soldering, in an essentially fork-shaped carrier, the latter being joined to the head of the mounting member. One advantage of this brush element according to the invention resides in that its working element can be exchanged in an especially easy way, unless the entire brush element consisting of mounting member and working element is exchanged as a unit anyway. In this connection, it should be pointed out that it is also possible on account of the present invention to exchange, as one entity, mounting strips joined to the brush elements.

It is preferred within the scope of this invention to make the slot arranged in the head of the mounting member to be undercut, and to design the part of the working element inserted in the slot to be of a correspondingly matching positional design. Thereby, the hold of the working element in the mounting member is improved. In this connection, it is preferred that the part of the working element inserted in the slot has a rib pointing in the forward direction, based on the direction of rotation.

The brush element according to this invention is preferably distinguished in that the support is joined to the head of the mounting member by at least one screw, one rivet, or the like. The stress on the screw or the like can be reduced according to the invention by providing that the shank of the screw, rivet, or the like fixing the working element in the head of the mounting member has a smaller diameter than the hole in the working element.

Ordinarily, the brush element according to this invention will be designed so that the bifurcate part of the support wherein the working element of hard material is received projects past the head of the mounting member.

In accordance with a preferred embodiment, the brush element of this invention is characterized in that the support, as seen in lateral view, is fashioned to be asymmetrical, the platelet serving as the working element being arranged to be symmetrical essentially to the plane of the surface of the support from which the elbow-forming tine section emanates.

The provision can advantageously be made within the scope of the invention that the working element is located in the support in an oblique fashion, preferably with a free edge pointing obliquely forwardly as based on the direction of rotation.

If the working element is intended for a stripping treatment (e.g. for removal of abraded rubber), then it is recommended that the surface of the support of the working element located at the front, based on the direction of rotation, be of a concave configuration.

Additional details and features of the invention can be seen from the dependent claims as well as from the following description of preferred embodiments illustrated in the drawings wherein:

FIG. 1 shows the apparatus in a lateral view,

FIG. 2 shows a top view of the apparatus of FIG. 1,

Figure 5:
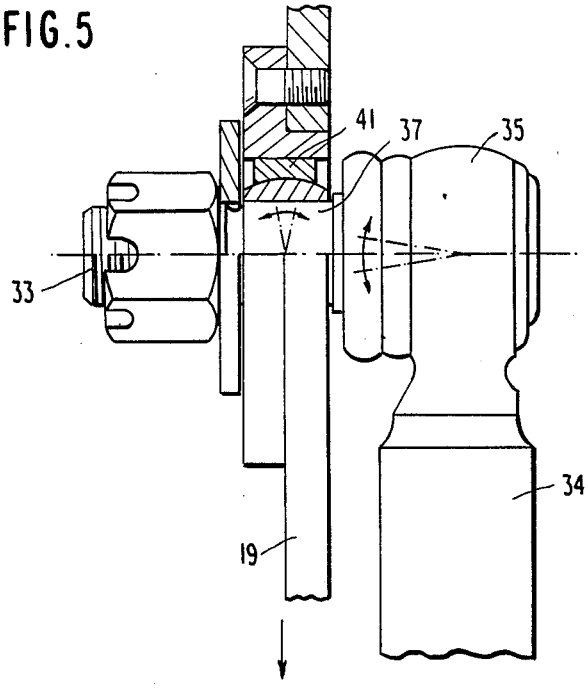
Figure 6:
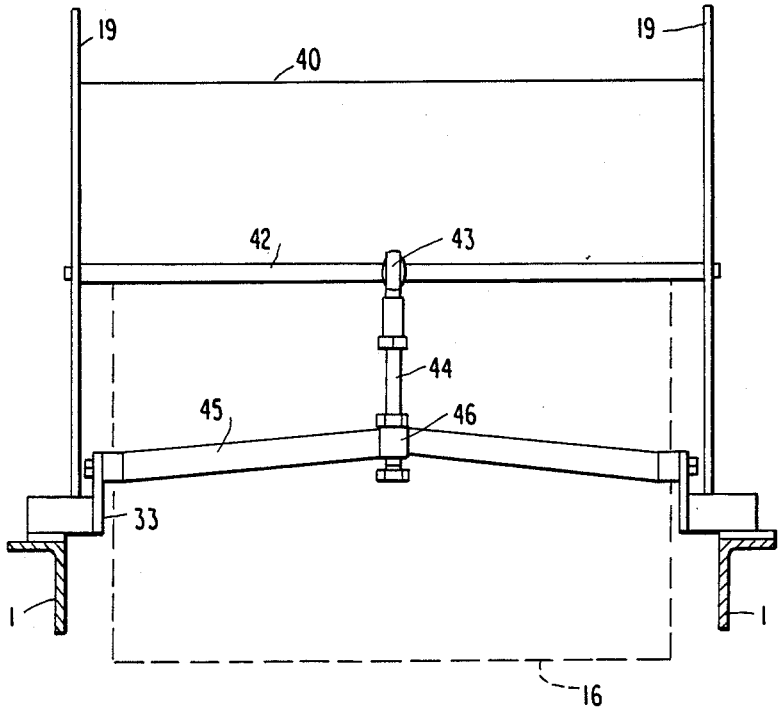
Figure 7:
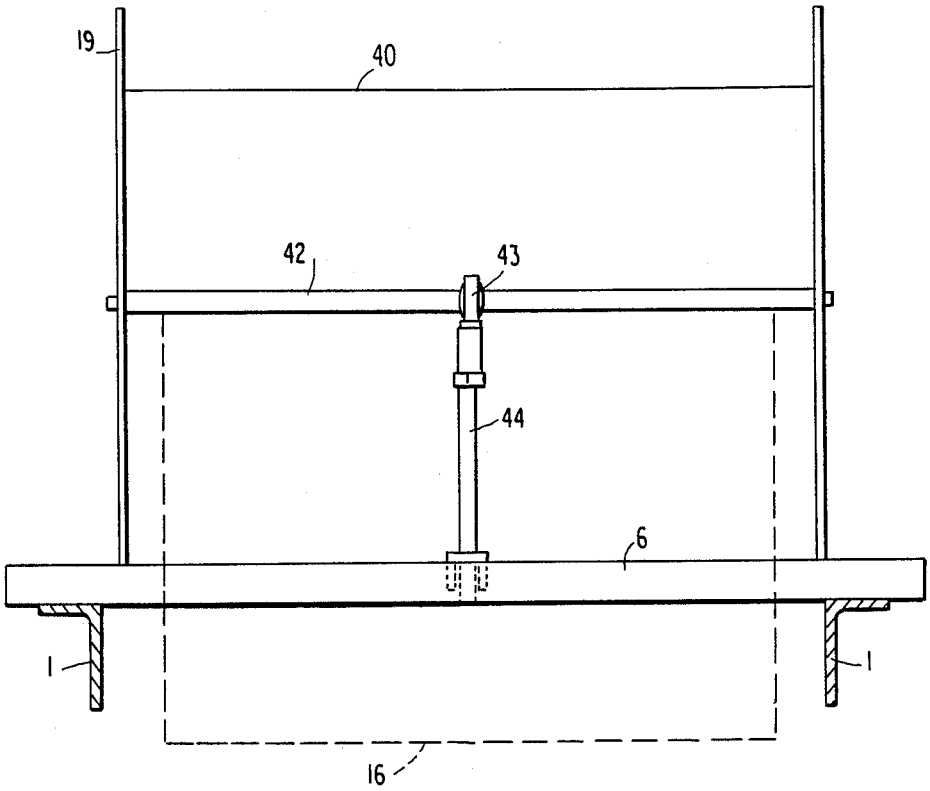
Figure 8:
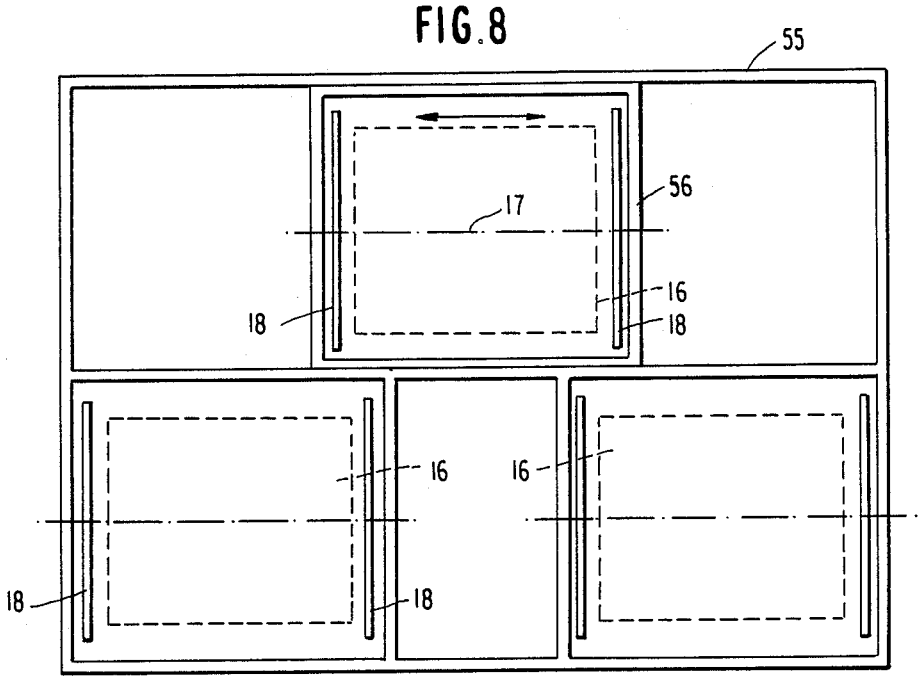

FIG. 3 shows an elevational view of the apparatus as seen from the left-hand side of FIG. 1, and FIG. 4 shows the forward bearing of the support for the roll, FIG. 5 shows a detail of FIG. 4, FIG. 6 shows another embodiment of the forward bearing of the support for the roll, FIG. 7 shows another embodiment of the forward bearing of the support for the roll, FIG. 8 shows an embodiment with several rotary brushes, FIG. 9 shows a schematic view of supplying pressure to the pneumatic servo member, FIG. 10 shows, in an axial sectional view, a portion of a rotary brush, FIG. 11 is an end view of the rotary brush according to FIG. 1, FIG. 12 shows, in a perspective view, a mounting strip with mounting shaft, FIGS. 13*a* and 13*b* show two alternative embodiments of the rotary brush, FIG. 14 shows a brush element, and FIGS. 15 and 16 show two embodiments of working elements.

The embodiment of the invention as illustrated in FIGS. 1 through 5 comprises a frame 1 supported via a rearward pair of wheels 2 and a pair of forward, steerable wheels 3 on the surface 4 of the traffic area 5 to be treated.

The steerable front wheels 3 are joined to the frame 1 by way of an auxiliary frame 6; for this purpose, bushings 7, through which cotter pins 8 are passed, are connected to the auxiliary frame 6 which latter is substantially of an L-shape in cross section. The cotter pins 8 pass furthermore through fishplates 9 and 10 attached to the frame 1. By pulling out the cotter pins 8 which are secured by means of securing pins (not shown), the auxiliary frame 6 can be removed together with the front wheels 3 and the steering linkage 11 as well as the thill 12.

Two stays 13 pointing upwardly from the frame 1 are provided in the region of the rear wheels 2. Connecting points 14 and 15 for connecting guide rods are provided in the stays 13, by way of which the apparatus can be connected to a hoisting mechanism provided at a push-cart when the front axle (auxiliary frame 6 with the components erected thereon) or when the thill 12 has been removed. In this mode of utilizing the apparatus of this invention, the apparatus freely protrudes in the forward direction from the rear wheels 2 traveling on the surface 4 of the traffic area 5 and is held by the push vehicle by way of the connecting points 14 and 15. This version has the advantage that the apparatus runs via its rear wheels 2 on the already treated surface of the traffic area 5. This form of usage will be employed in case of extensive terrain roughness, such as, for example, in case of frozen snow compacted by vehicles on roadways. If the thill 12 only is removed, the apparatus runs on all four wheels 2 and 3, the front wheels 3 being self-steering as following wheels.

A roll 16 is mounted at the frame 1 by way of a support 18 to be rotatable about an axis 17 and can be driven by means of a drive motor, e.g. a hydraulic motor, not shown in detail. To keep the roll 16 in balance, a counterweight can be arranged at the support 18 on the side in opposition to the drive motor.

The support 18 consists, in the illustrated embodiment, of two substantially vertically oriented plates 19 arranged on both sides of the roll 16; these plates are connected to each other rigidly via sheet-metal panels forming a roll housing 40. The support is mounted to be pivotable about an axis 20 with respect to the frame 1.

The support 18 rests on the frame 1 in the zone of the rear wheels 2 by means of a dual-acting pressure medium motor 21. The free end of the piston rod 22 of the pressure medium motor 21 engages, for this purpose, at a guide arm 23 mounted to be pivotable upwardly and downwardly about an axle 24 provided between the stays 13. The pressure medium motor 21 is supported, in turn, between the stays 13 on the frame 1. The free end of the guide arm 23 is connected, by way of an arm 25 pivotably connected to the latter, with a crossbeam 26 joining the two plates 19 of the support 18. The arm 25 is articulated to the guide arm 23 as well as to the crossbeam 26, i.e. to the support 18.

Furthermore, the support 18 is guided in slotted guides 28 provided at the stays 13 by way of sliding blocks 27 arranged on its two plates 19.

By acting on the piston in the pressure medium motor 21 from below, i.e. by way of its connection 29, the roll 16 can be lifted. By acting on the piston accommodated in the pressure medium motor 21 from the top, i.e. by way of its connection 30, a counterpressure is built up in the pressure medium motor 21, which latter is a dual-acting pressure medium motor, so that the roll 16 is resiliently held in the selected vertical position with respect to the surface 4 of the traffic area to be worked. The pressure medium motor 21 is preferably operated with a gaseous pressure medium, the latter being supplied via a storage means for the pressure medium (accumulator) at a preselectable, constant pressure so that the pressure medium motor 21 acts like the combination of a servo member effective from the bottom toward the top and a servo member acting from the top toward the bottom and maintains the roll 16 in the aforedescribed floating position.

Additionally, the roll 16 can be pivoted in the frame 1 about an axis aligned perpendicularly to its axis 17 and oriented substantially horizontally, i.e. in parallel to the frame 1.

For this purpose, the articulated connection 31 between the guide rod 23 and the arm 25 and/or the connection between the arm 25 and the support 18 is designed with a corresponding play, or the joints 31 and/or 32 are fashioned as ball-and-socket joints.

The forward end of the support 18 is supported with respect to the frame 1 by way of arms 33 freely projecting obliquely upwards in the forward direction; these arms are arranged on both longitudinal supports of the frame 1 of the apparatus. Respectively one length-variable brace, for example a screw spindle 34, extends upwardly from the free ends of the arms 33. Ball-and-socket joints 35 are provided for connecting the screw spindles 34 and the two forward ends of the plates 19 of the support 18; axle stubs 37 connected with the plates 19 of the support 18 are received to be displaceable in the direction of their axis in bores in the balls of the ball-and-socket joints 35 (cf. FIGS. 4 and 5).

The axle stubs 37 are movably attached to the plates 19 of the support 18 of the roll 16 in such a way that they can be inclined from their position wherein they are perpendicular to the plates 19. This movable mounting can be provided by elastic shims or by the mounting structure of the axle stubs 37 as is illustrated in FIG. 5. In the embodiment illustrated in FIG. 5, the axle stubs 37 are supported in the plates 19 of the support 18 by way of pivot bearings 41.

The forward support for the carrier 18 of the roll 16 can also be designed as shown in FIG. 6. In this embodiment, a crossbeam 42 fashioned as a molded tube is provided which is joined to the plates 19 at its two ends. In the center, the crossbeam 42 passes through a ball-and-socket joint 43 arranged at the upper end of an adjusting spindle 44. The lower end of the adjusting spindle rests via a traverse 45 and the arms 33 on the frame 1 of the apparatus.

In order to compensate for the weight of the drive motor for the roll 16, located on one side of the support 18 of the roll 16, the point of attack of the adjusting spindle 44 can be located eccentrically at the support (crossbeam 42).

In this way, the roll 16 in conjunction with the articulated suspension of the support 18 can tilt about an axis oriented transversely to its axis of rotation 17, in the zone of the rear axle 2.

This tilting ability is even further facilitated by fashioning the surfaces of the sliding blocks 27, located on both sides of the trunnions of the sliding blocks 27 and being in contact with the slotted guide 28 on both sides of the slot provided therein, to have a convex curvature.

Another embodiment of the forward support is shown in FIG. 7 wherein the spindle 44 is resting by way of a fork on a fishplate fastened to the auxiliary frame 6. In this embodiment, the auxiliary frame 6 with the structures mounted thereon cannot be removed.

The apparatus can be adapted by horizontal and vertical adjustment, on account of the aforedescribed mounting of the roll 16 in the frame 1 of the apparatus, to the respective requirements during its use, to remove layers from the surface of traffic areas, such as dirt, snow, ice, paint, abraded rubber, or the like, or in order to roughen, smooth, strip, etc., the surfaces proper (e.g. asphalt or concrete cover).

By pressurizing the lower part of the pressure medium motor 21 via the connection 29, the piston in the pressure medium motor 21 is acted upon from the bottom and raises the roll 16. By subsequent operation of the piston from the top via connection 30 of the pressure medium motor 21, the roll is lowered to the desired level of its axis 17. On account of the forces exerted by the servo members on the roll during use of the apparatus, the roll 16 is maintained resiliently in a floating position.

By adjustment of the desired pressures with which the pressure medium motor 21 is operated (pressurization takes place via a pneumatic accumulator for the pressure medium), it is possible to set not only the vertical alignment of the roll 16, but also its contact pressure against the surface 4 to be treated on the traffic area 5.

It is likewise possible to rigidly fix the roll 16 in position with respect to the frame 1 of the apparatus by pressurizing the pressure medium motor 21 in such a way that the sliding blocks 27 contact the upper or the lower end of the slots in the slotted guide means 28.

When using, in place of the dual-acting pressure medium motor 21 described in the above embodiment, a single-acting pressure medium cylinder 50 for supporting the rear end of the frame 1 of the apparatus, then this cylinder, as shown in FIG. 9, can be supplied with compressed air from a compressed air source by way of a pressure accumulator 51 with manometer 52. The pressure medium cylinder 50 is ordinarily supplied with compressed air in such a way that, with the rotary brush 16 at a standstill, the sliding blocks 27 are just barely in contact with the lower end of the slotted guide means 28. As soon as the rotary brush 16 is set into rotation, the latter is lifted with its support 18 under the effect of the working elements acting on the surface to be treated. If the penetration depth of the rotary brush is to be changed, this can be achieved by changing the pressure of the compressed air acting on the pressure medium motor 21.

The embodiment of the apparatus illustrated in FIG. 8 comprises three rotary brushes 16 carried by way of supports 18 in a frame 55; the support arrangement corresponds to the mounting of the support 18 in frame 1. One of the supports 18 is displaceable in the direction of the axis of rotation 17 of the rotary brush 16 by way of an auxiliary frame 56 in the frame 55, in directions shown by the double arrow in FIG. 8. Therefore, this rotary brush 16 can be located exactly in front of one of the two other rotary brushes 16 making it possible to effect double treatment in one working step.

A rotary brush 101 illustrated in FIG. 10 comprises a roller core 102 fashioned as a pipe extending over the length of the rotary brush 101; this roller core exhibits on its inner surface, for example, four grooves 104 running in parallel to the longitudinal axis 103 of the rotary brush 101. A drive and mounting shaft, not shown, is inserted, for example, in the brush core; this shaft has ribs corresponding to the grooves 104 on its outer circumference in order to ensure a shape-mating connection between the drive shaft and the rotary brush 101.

Mounting strips 106 are arranged on the outer surface 105 of the brush core 102 and extend in parallel to the axis 103, as can be seen from FIG. 12, for example. The number of the mounting strips 106 arranged in uniform distribution over the periphery of the brush core 102 is extensively arbitrary and depends, in particular, on the diameter of the rotary brush 101 and its intended usage.

Each mounting strip 106 carries, in uniform distribution over its length, extensions 107 that point radially outwardly. Holes 108 oriented in parallel to the axis 103 of the rotary brush 101 are provided in the extensions 107 of the mounting strips 106; a rod-shaped mounting shaft 109 is extended through these holes.

The surface 110 of the mounting strip resting on the outer peripheral surface 105 of the brush core 102 preferably is designed with a concave curvature, as indicated by the dashed line 110' in FIG. 12; the radius of curvature of surface 110 is, in particular, somewhat smaller than the radius of curvature of the outer peripheral surface 105 of the brush core 102.

The mounting shaft 109, to which are attached, for example, the holding members for working elements known from EP-A 0,172,157, or the brush elements described further below with reference to FIGS. 15 and 16, exhibits at one end a substantially U-shaped bracket 111 extending around the outermost extension 107 of each mounting strip 106. The mounting shaft 109 is nonrotationally connected with this bracket 111, for example by means of rivets. At the other end, the mounting shaft 109 is equipped with a thread, not shown, to which a nut can be attached in order to fix the mounting shaft 109 to the mounting strip 106.

The brush core can be constituted, instead of by a continuous tube, also by mutually spaced-apart rings 112 likewise carrying grooves 104 on their inner surfaces. As illustrated in FIG. 13, the mounting strips 106 can be directly threaded to the rings 112 forming the brush core (FIG. 13, top half), or connecting strips 113 are provided lying on the outsides of the rings 112 and threadedly connected with the rings 112. The mounting strips 106, in this case, are threaded to the connecting strips 113, as in the embodiment illustrated in FIG. 13, bottom half.

The screws joining the mounting strips 106 to the tubular brush core 102 and/or to rings 112 constituting a brush core, or the screws connecting the connecting strips 113 to these rings 112 and the mounting strips 6 with the connecting strips 113, are indicated in FIGS. 10 and 13 by dot-dash lines and preferably are socket head screws to which are threaded locknuts, preferably radially inwardly.

In the embodiments of the rotary brush 101 shown in FIG. 10 as well as in FIGS. 13*a* and 13*b*, the provision can also be made, to take the place of the continuously extending drive and mounting shaft, that coupling means are inserted in the ends of the rotary brush 101 which connect the rotary brush 101 nonrotationally with the drive means for the rotary brush 101 and serve simultaneously as bearings for the rotary brush 101.

A brush element usable preferably in conjunction with the rotary brush 101 described in connection with FIGS. 10–13 is illustrated in FIG. 14. This brush element 114 has, in the embodiment shown in FIG. 14, a head 115 and a shank 116 exhibiting at its (radially inward) end a holder 117 with a bore 118 intended for accommodating the mounting axle 109, i.e. for connection with the brush core 102 (or 112) of the rotary brush 101 according to the invention. The direction of rotation of the rotary brush 101 is indicated in FIG. 14 by the arrow 119.

A slot 121 open toward the free end of head 115 is provided in the head 115 of the holding member: 114; a working element 120 is attached in this slot with the aid of a screw 122.

The working element 120 comprises a carrier 123 shaped to be bifurcate in its zone projecting past the head 115 of the holding member 114 and receiving between its tines a platelet 124 of a hard material, for example a hard metal. The platelet 124 is inserted in the carrier 123 in such a way that it is arranged symmetrically to the surface 125 of the carrier 123 from which the elbow-forming tine 126 of the fork-shaped part of carrier 123 originates.

Depending on whether or not there is a clearance between the radially inward end face 127 and the radially outwardly oriented surface of the mounting strip 106 lying between extensions 107, the brush element 114 is fastened to the mounting strip 116 to be pivotable (to a greater or lesser extent) or to be rigid.

In the embodiments illustrated in FIGS. 15 and 16, the part of the carrier 123 inserted in the slot 121 of head 115 is profiled by the provision of a rib 130. Also the slot 121 is profiled in these versions, i.e. it is fashioned to be undercut. Other cross-sectional shapes of the slot 121 are likewise& possible. Thus, the slot can be designed undercut in an L-, T-, V-shaped configuration.

The shim 124 of hard material is oriented, in the embodiments of FIGS. 15 and 16, to be inclined with respect to the longitudinal extension of the mounting member 114, the free end of the latter, based on the direction of rotation (arrow 119) of the rotary brush 101, pointing forwards.

The surface 133 of the carrier 123 at the front based on the direction of rotation (arrow 119) can have a concave curvature, as illustrated in FIG. 16.

The hole 132 in the carrier 123 has a larger diameter than the shank 131 of the mounting screw 122 (or rivet) so that play exists between the shank 131 and the hole 132.

As can be derived from FIGS. 15 and 16, the carrier 123 of the working element 120 has a shoulder 134 by way of which the carrier 123 rests on the head 115 of the mounting member when the working element impinges on the surface to be treated. For this purpose, the shoulder 134 is provided on the side of the carrier 123 which is at the rear with respect to the direction of rotation (arrow 119) of the rotary brush 101.

I claim:

1. Apparatus for treating the surface of traffic areas with the aid of a motor-driven roll (16) rotatable about a substantially horizontally extending axis, this roll carrying working elements on its circumference, these elements acting on the surface to be treated, wherein the roll (16) is mounted in a support (18) having an end supported on the frame (1) of the apparatus, this frame being supported on the traffic area by wheels, said support being pivotable about an axis (20) parallel to the axis of rotation (17) of the roll (16), and the other end of said support coupled with at least one servo member (21) resting on the frame (1) of the apparatus, characterized in that the roll (16) is held in the desired vertical position, as regards the traffic area (5) to be treated, with respect to the frame (1) of the apparatus by means of said at least one servo member (21) which is a pressure medium motor that can be acted upon by a pressure medium at a preselectable, constant pressure; that the pressure medium motor serving as the servo member (21) can be supplied with the pressure medium by way of an accumulator for the pressure medium at a preselectable, constant pressure; that the end of the support (18) where the servo member (21) engages is guided to be displaceable upwardly and downwardly along the frame (1) of the apparatus; and that the roll (16) can be tilted about an axis (17) perpendicular to its axis and disposed essentially horizontally.

2. Apparatus according to claim 1, characterized in that the support, (18) comprises two plates (19) arranged on both ends of the roll (16), these plates being rigidly connected to each other by way of sheet-metal panels fashioned as a roll housing (40).

3. Apparatus according to claim 1, characterized in that the servo member (21) rests, on the one hand, on the frame (1) of the apparatus and, on the other hand, engages a guide rod (23) pivotably connected to the frame (1) of the apparatus by means of stays (13) projecting upwardly therefrom, this guide rod, in turn, being articulated to the support (18).

4. Apparatus according to claim 3, characterized in that the guide rod (23) is connected by way of an arm (25) to a crossbeam (26) joining two plates (19) of the support (18), said two plates being rigidly connected to each other.

5. Apparatus according to claim 1, characterized in that vertical guide means of the end of support (18) for the roll (16), on which the servo members (21) act, exhibits slotted guides (28) connected with the frame (1) and sliding blocks (27) which engage into the slotted guides and are connected to the support (18).

6. Apparatus according to claim 5, characterized in that the stroke of the end of the support (18) adjacent the servo member (21) is limited by the length of the slots of the slotted guide (28) engaged by the sliding blocks (27).

7. Apparatus according to claim 1, characterized in that the end of the support (18) lying in opposition to the servo members (21) and pertaining to the roll (16) is supported with the aid of adjusting spindles (34) to be vertically adjustable on the frame (1) of the apparatus.

8. Apparatus according to claim 7, characterized in that connecting joints (35) between upper ends of the adjusting spindles (34) and plates (19) of the support (18) for the roll (16) are articulatable transversely to the axis of rotation (17) of the roll (16).

9. Apparatus according to claim 8, characterized in that the joints (35) are fashioned as ball-and-socket joints, wherein axle stubs (37) provided on the plates (19) of the support (18) and facing inwardly are accommodated in balls of the joints (35), which are ball-and-socket joints, to be displaceable in the direction of their axes.

10. Apparatus according to claim 9, characterized in that the axle stubs (37) are pivotably attached to the plates (19) of the support (18).

11. Apparatus according to claim 10, characterized in that the axle stubs (37) are elastically attached to the plates (19) of the support (18).

12. Apparatus according to claim 7, characterized in that the adjusting spindles (34) are supported on the frame (1) of the apparatus to be pivotable by way of levers (33) which project freely in the forward, direction.

13. Apparatus according to claim 12, characterized in that the axle stubs (37) are attached to the plates (19) of the support (18) by way of ball-and-socket joints (41).

14. Apparatus according to claim 1, characterized in that an articulated connection between the free end of the guide rod (23) at which the servo member (21) engages and the support (18) of the roll comprises at least one ball-and-socket joint (31, 32); and that the sliding blocks (27) provided at the support (18) contact the slotted guides (28) with spherical surfaces.

15. Apparatus according to claim 1, characterized in that stays (13) projecting upwardly from the frame (1) exhibit attachment points (14, 15) for connecting guide rods; and that front wheels (3), designed to be steerable and being connected to a thill (12), are detachable.

16. Apparatus according to claim 15, characterized in that an auxiliary frame (6) accommodating the front wheels (3) including the thill (12) is provided which can be detached from the frame (1) of the apparatus.

17. Apparatus according to claim 16, characterized in that the auxiliary frame (6) is connected to the frame (1) by means of bolts (8), fastened by securing pins.

18. Apparatus according to claim 1, characterized in that a crossbeam (42) is provided in the zone of the axis (20) of the support (18) and connects plates (19) on the latter; and that a length-variable support (44) is provided which supports the crossbeam (42) on the frame (1) of the apparatus.

19. Apparatus according to claim 18, characterized in that the support (44) rests on the frame (1) by way of a transverse carrier (45).

20. Apparatus according to claim 18, characterized in that the crossbeam (42) is articulated to the support (44) by a ball-and-socket joint (43).

21. Apparatus according to claim 18, characterized in that an adjusting spindle is provided as the support (44), this spindle being threaded into a threaded bushing (46) of the crossbeam (45).

22. Apparatus according to claim 18, characterized in that the support (44) engages eccentrically the transverse carrier (45).

23. Apparatus according to claim 1, characterized in that the roll (16) is held at the desired vertical position as regards the traffic area (5) with respect to the frame (1) of the apparatus by at least two said servo members (21) acting in opposite directions, these servo members being pressure medium motors pressurizable with a pressure medium at a preselectable, constant pressure.

24. Apparatus according to claim 23, characterized in that the pressure medium motors serving as the servo members (21) comprise a dual-acting servo member (21).

25. Rotary brush for treating traffic areas, for removing from the surface thereof layers of dirt, snow, ice, paint, abraded rubber, or the like, with a brush core to which are attached working elements arranged on holding members, by holders provided on the outer periphery of the brush core and pivotably movable about axes parallel to the brush axis, for use in an apparatus according to claim 1, characterized in that the holders are fashioned as mounting strips (106) extending in the longitudinal direction of the axis (103) of the rotary brush (101), these mounting strips being connected, resting on the radially outwardly disposed peripheral surface (105) of the brush core (102, 112), to the latter.

26. Rotary brush according to claim 25, characterized in that the mounting strips (106) are releasably joined to the brush core (102, 112) by means of screws wherein the screws are socket head screws with locknuts.

27. Rotary brush according to claim 25, characterized in that the mounting strips (106) exhibit surfaces (110')

resting on the brush core (102, 112) and being of concave configuration in correspondence with the curvature of the brush core (102, 112).

28. Rotary brush according to claim 27, characterized in that the radius of curvature of the surface (110') of the mounting strips (106) resting on the brush core (102, 112) is smaller than the radius of the outer circumferential surface (105) of the brush core (102, 112).

29. Rotary brush according to claim 25, characterized in that the mounting strips (106) exhibit outwardly pointing, mutually spaced extensions (107) which have holes (108) oriented in parallel to the axis (103) of the rotary brush (101) for receiving a mounting shaft (109) for the working elements or their holding members (114, 120).

30. Rotary brush according to claim 29, characterized in that a substantially U-shaped bracket (111) is provided at one end of the mounting shaft (109), this bracket extending around an axially outermost extension (107) of the mounting strip (106); and that there are provided at the other end of the mounting shaft (109) a threaded section and a nut threaded on the latter.

31. Rotary brush according to claim 25, characterized in that mutually adjacent mounting strips (106) are connected to the brush core (102, 112) so that they are offset in the longitudinal direction of the brush core.

32. Rotary brush according to claim 25, characterized in that the brush core (102) is fashioned as a continuous tube.

33. Rotary brush according to claim 32, characterized in that longitudinally extending grooves (104) are arranged on the inner surface of the brush core (102) which grooves are engaged by longitudinally extending ribs provided on a drive shaft for the rotary brush (101).

34. Rotary brush according to claim 25, characterized in that coupling means are provided at the end faces of the brush core (102,112) for connecting the latter to a drive motor and/or to the bearings of the rotary brush (101).

35. Rotary brush according to claim 34, characterized in that cover disks with corresponding apertures are attached to the end faces of the brush core by welding, longitudinally extending ribs provided on a drive shaft for the rotary brush (101) engaging into these apertures.

36. Brush element with a working element which latter is connected by way of a holding member to the brush core of a rotary brush according to claim 25, wherein the working element is attached to the holding member in a slot of a radially outwardly located head of the holding member, characterized in that the working element (120) exhibits a platelet (124) of a hard material, attached in a substantially fork-shaped carrier (123), the latter being connected to a head (115) of a holding member (114).

37. Brush element according to claim 36, characterized in that a slot (121) provided in the head (115) of the holding member (114) is undercut, and the part of the working element (120) inserted in the slot (121) has a corresponding counter profile.

38. Brush element according to claim 37, characterized in that the part of the working element (120) inserted in the slot (121) has a rib (130) which points in the forward direction, based on the direction of rotation (arrow 119) of the rotary brush.

39. Brush element according to claim 36, characterized in that the carrier (123) is connected with the head (115) of the holding member (114) by at least one screw (122).

40. Brush element according to claim 39, characterized in that the shank (131) of a screw (122), fixing the working element (120) in place in the head (115) of the holding member (114) has a smaller diameter than a hole (132) in the working element (120).

41. Brush element according to claim 36, characterized in that the bifurcate part of the carrier (123) wherein the working element (124) of a hard material is received projects past the head (115) of the holding member (114).

42. Brush element according to claim 35, characterized in that the carrier (123) is asymmetrical as seen in lateral view, a platelet (124) serving as the working element being arranged substantially symmetrical to the plane of a surface (125) of the carrier (123) from which an elbow-forming tine section (126) originates.

43. Brush element according to claim 36, characterized in that the carrier (123) is asymmetrical as seen in lateral view, a platelet (124) serving as the working element being arranged substantially asymmetrically with respect to the plane of a surface (125) of the carrier (123) from which an elbow-forming tine section (126) originates.

44. Brush element according to claim 36, characterized in that the platelet (124) is arranged in the working element (120) in an oblique fashion with a free edge that points obliquely forwardly as based on the direction of rotation (arrow 119).

45. Brush element according to claim 36, characterized in that a surface (133) of the carrier (123) of the working element (120) which is at the front as seen in the direction of rotation (arrow 119) is concave.

46. Brush element according to claim 36, characterized in that the carrier (123) of the working element (120) exhibits a shoulder (134) in contact with a radially outwardly pointing surface of the head (115) of the holding member (114).

47. Brush element according to claim 46, characterized in that the shoulder (134) is provided on the side of the carrier (123) that is at the rear, based on the direction of rotation (arrow 119) of the rotary brush (101).

48. Rotary brush according to claim 1, characterized in that the brush core is constituted by spaced-apart rings (112).

49. Rotary brush according to claim 48, characterized in that the mounting strips (106) are directly threaded to the rings (112).

50. Rotary brush according to claim 48, characterized in that the rings (112) are joined together by longitudinally extending connecting strips (113) wherein the mounting strips (106) rest on radially outwardly disposed surfaces of the connecting strips (113) and are joined to the latter.

* * * * *